US005501632A

United States Patent [19]

Adams et al.

[11] Patent Number: 5,501,632

[45] Date of Patent: Mar. 26, 1996

[54] COIN SORTER SECURITY COMPARTMENT

[75] Inventors: Thomas P. Adams, Oconomowoc; Kerry Karpathian, Waukesha; Roger Klemp, Watertown; Thomas S. Murphy, Lake Mills, all of Wis.

[73] Assignee: Brandt, Inc., Watertown, Wis.

[21] Appl. No.: 422,970

[22] Filed: Apr. 17, 1995

[51] Int. Cl.[6] ..... G07D 3/00

[52] U.S. Cl. ..... 453/3; 141/314; 232/15

[58] Field of Search ..... 453/3–15; 194/350; 232/15, 16; 221/82; 312/326; 141/10, 314–317; 53/469

[56] References Cited

U.S. PATENT DOCUMENTS

| | | | |
|---|---|---|---|
| 1,225,866 | 5/1917 | Schrears . | |
| 3,888,442 | 6/1975 | Comeaux | 248/98 |
| 4,586,522 | 5/1986 | Taipale et al. | 453/10 |
| 4,620,559 | 11/1986 | Childers et al. | 453/6 |
| 5,131,499 | 7/1992 | Hoar | 186/66 |
| 5,210,994 | 5/1993 | Lynn | 53/469 |
| 5,297,598 | 3/1994 | Rasmussen | 141/314 |

OTHER PUBLICATIONS

Brandt Model 6500 Series High Speed Coin Sorter and Counter Maintenance Manual, 1993, Introduction, and Section Nos. 1, 2, and 8.

*Primary Examiner*—F. J. Bartuska
*Attorney, Agent, or Firm*—Quarles & Brady

[57] ABSTRACT

A security compartment for a coin handling apparatus mounted on a stand has a stationary enclosure attached to the rear of the apparatus and to the stand. A shroud is rotatably mounted on the stand. The shroud has an opening which may be hidden by the enclosure or exposed when the shroud is rotated to provide access to coin containers at the front of the coin handling apparatus. A locking mechanism is provided to lock the shroud in a closed position where the opening is hidden by the enclosure.

15 Claims, 3 Drawing Sheets

COIN SORTER SECURITY COMPARTMENT

BACKGROUND OF THE INVENTION

This invention relates to coin handling equipment, and particularly to a security compartment for providing secured access to coin containers in a coin handling apparatus such as a coin sorter.

Coin sorters typically deposit the sorted coins into drawers or bags, with at least one drawer or bag assigned for each denomination of coin to be sorted. When coins are deposited into drawers, it is relatively simple to provide locks or other security mechanisms to prevent the unauthorized removal of the drawers. When bags are used, it is typical to provide an enclosure for the entire array of bags with one or more lockable hinged doors to permit access to the bags. The enclosures are typically formed metal housings that may be insulated to provide some sound deadening.

It is a principal object of the present invention to provide an improved lockable compartment for denying access to coin bags or other coin containers on a coin sorter or other coin handling machine.

It is another object of the invention to provide such a security compartment of simplified construction that does not use hinged doors for providing access.

It is also an object of the present invention to provide a security compartment where major components can be manufactured from molded or formed plastic, such as polyethylene, which provide inherent sound deadening.

SUMMARY OF THE INVENTION

In accordance with the invention, the security compartment is designed for use with a coin handling apparatus that has a circular array of coin containers. A stationary enclosure is mounted on one side of the coin handling apparatus away from the coin containers. A shroud for the containers is mounted for rotation about an axis substantially at the center of the containers. The shroud has an opening that may be either hidden by the enclosure or exposed to provide access to the coin containers when the shroud is rotated.

The coin containers preferably occupy a major portion of a circle and the stationary enclosure encloses the portion of the circle that is not occupied by the coin containers.

Further in accordance with the invention, a locking mechanism is provided that engages the shroud when the opening is hidden by the enclosure to prevent rotation of the shroud to expose the opening. The locking mechanism is mounted on the enclosure.

Also in accordance with the invention, the security compartment is used with a coin sorter having coin containers adjacent the front of the sorter. The sorter is supported on a stand. A stationary enclosure is connected to the stand at the rear of the sorter. A shroud for the containers has an opening. The shroud is mounted on the stand for movement between a position in which the opening is within the enclosure and positions in which the opening is free of the enclosure and provides access to the coin containers.

In the preferred embodiment, the coin handling apparatus has a plurality of coin spouts for coin bags. The coin handling apparatus is supported on a stand having an upright shaft at the center of the array of spouts. The stand also has a circular floor spaced below the spouts. The stationary enclosure is connected to the stand and to the apparatus. The shroud is rotatably mounted on the shaft beneath the floor.

The shroud extends from beneath the level of the floor to above the level of the spouts.

Also in the preferred embodiment, the locking mechanism includes a manually movable latch that is engageable with the shroud when the shroud is rotated to the position in which the opening is hidden by the enclosure. A lock that includes a lever engages the latch to prevent movement when the lock is locked.

The foregoing and other objects and advantages of the invention will appear in the detailed description that follows. In the description, reference is made to the accompanying drawings which illustrate a preferred embodiment of the invention.

DETAILED DESCRIPTION OF THE PREFERRED EMBODIMENT

Figure 1:
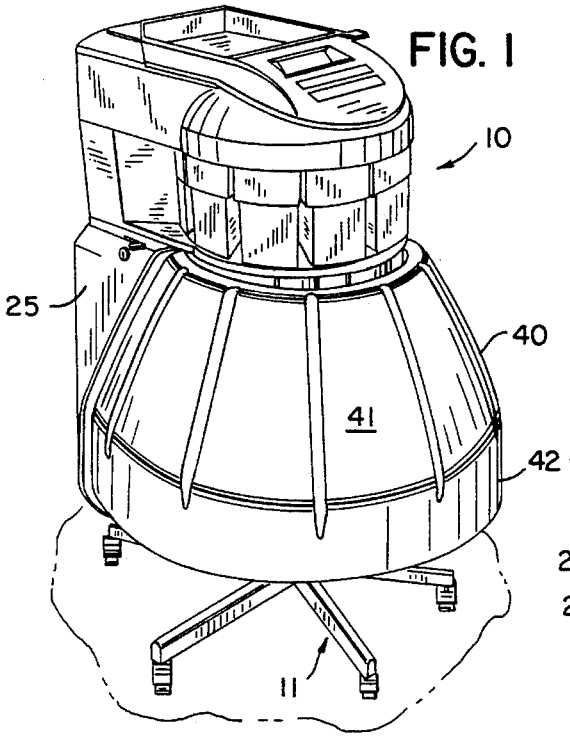
FIG. 1 is a view in perspective of a security compartment according to the invention as applied to a coin sorter.
Figure 2:
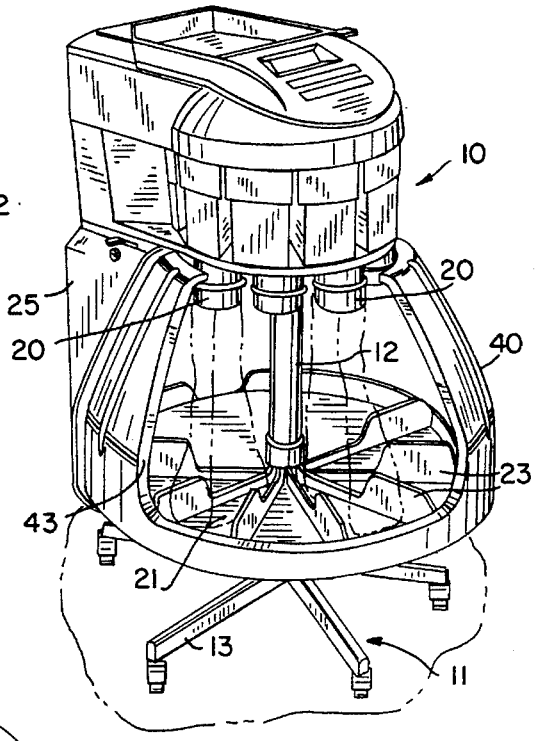
FIG. 2 is a perspective view similar to FIG. 1, but showing the shroud rotated to expose the opening.
Figure 3:
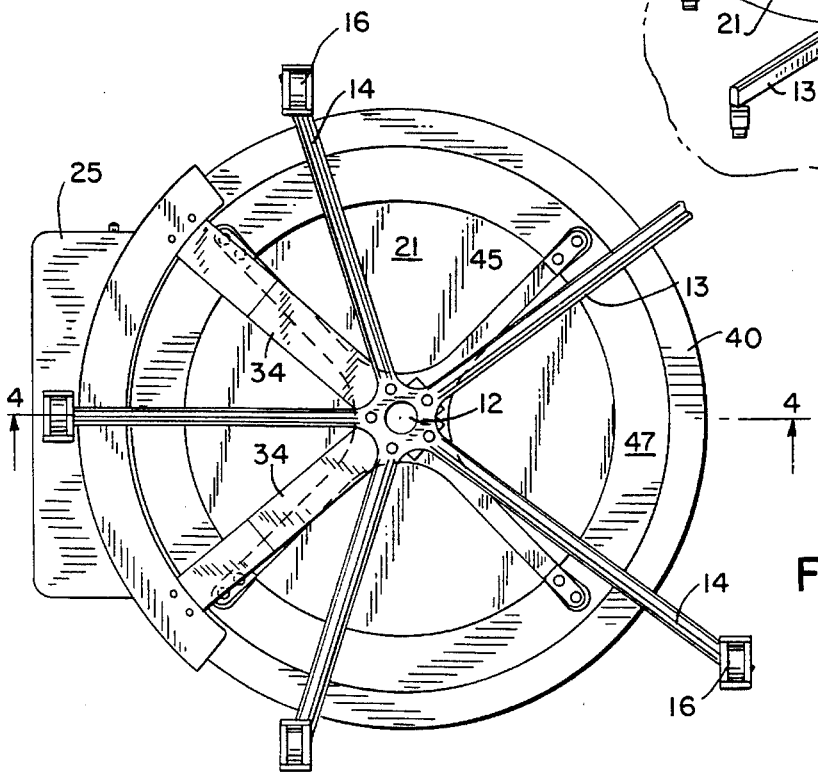
FIG. 3 is a bottom view of the security compartment of FIGS. 1 and 2.
Figure 4:
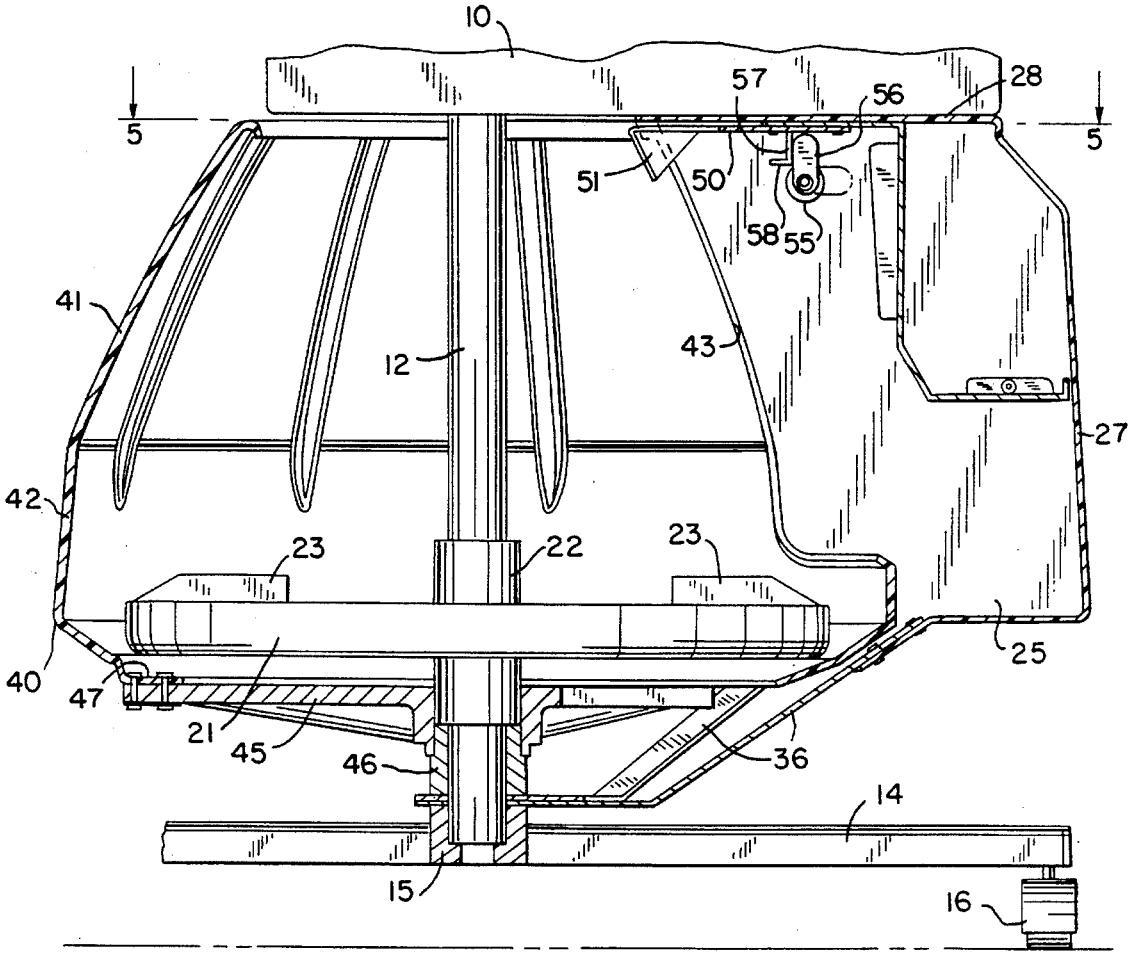
FIG. 4 is a view in vertical section taken in the plane of the line 4—4 of FIG. 3.
Figure 5:
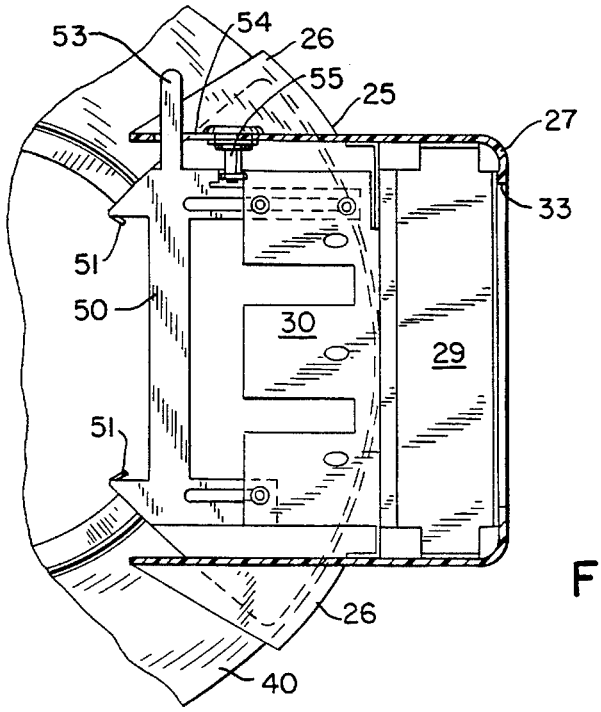
FIG. 5 is a partial top view taken in the plane of the line 5—5 of FIG. 4.
Figure 6:
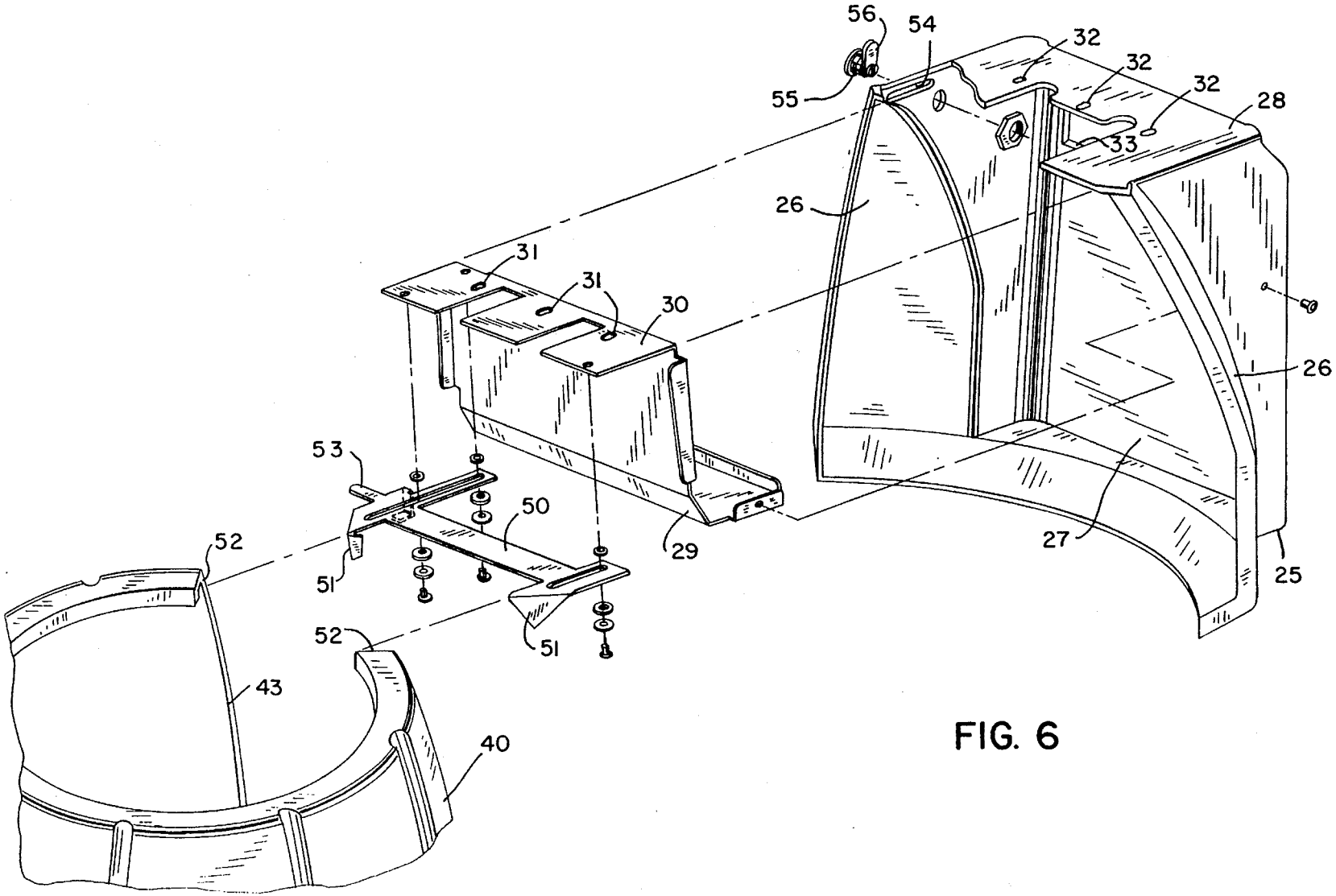
FIG. 6 is an exploded perspective view showing the interrelationship and assembly of the stationary enclosure, shroud, and locking mechanism.

The security compartment is shown in use on a coin sorter indicated generally by the numeral 10. The coin sorter is mounted on the top of a stand, indicated generally by the numeral 11 that includes an upright shaft 12 attached to the underside of the coin sorter 10 and a base 13 having a plurality of legs 14 radiating from a central socket 15 and each carrying a caster 16. As shown in FIG. 4, the shaft 12 is mounted in the socket 15.

The coin sorter is of the type illustrated and described in the co-pending U.S. patent application Ser. No. 08/213,322 for "Collector Assembly for Coin Handling Machine" now U.S. Pat. No. 5,443,419. The stand is more fully illustrated in co-pending U.S. Pat. application Ser. No. Des. 29/019941 for "Coin Sorter" now U.S. Pat. No. Des. D359,152. Both of the pending applications are assigned to the same assignee as this application, and the disclosures of both are hereby incorporated by reference as though fully set forth herein.

The coin sorter 10 has a plurality of spouts 20 at its front which extend downwardly and define discharge openings for sorted coins. The spouts 20 occupy a portion of the perimeter of a circle whose center is at the shaft 12. The spouts 20 are arranged to mount the open tops of coin bags, in a known manner. A circular floor 21 forms a part of the stand 11. The floor 21 has a central sleeve 22 secured to the shaft 12. A plurality of upright dividers 23 divide the floor into pie-shaped segments with one segment disposed beneath each spout 20.

The security compartment includes a rear stationary enclosure 25 having a pair of spaced flared sides 26 joined by a box-like rearward extension 27. The enclosure 25 has a flat top portion 28. A metal bracket 29 also has a top portion 30 with openings 31 that are aligned with openings 32 in the flat top portion 28 of the enclosure 25. Suitable fasteners (not shown) extend through the aligned openings 31 and 32 and attach the bracket 29 and enclosure 25 to the underside of the coin sorter 10. The bracket 29 extends downwardly and rearwardly and is riveted to the inside of the enclosure 25. The bracket 29 provides a shelf that is reachable through an opening 33 in the rear of the enclosure 25. The shelf may mount a multiple outlet electrical strip to receive multiple power cords for the sorter and related equipment. A pair of straps 34 extend from the bottom of the enclosure 25 to the shaft 12 to support the lower portion of the enclosure 25 in fixed relation to the shaft 12 of the stand 11.

A shroud 40 has a generally conical upper body 41 extending downwardly to a circumferential skirt 42. The body 41 and a portion of the skirt 42 are interrupted by an opening 43. The shroud 40 is mounted on the stand 11 by means of a multiple-armed support 45 having a central hub 46 rotatably mounted about the shaft 12 beneath the level of the floor 21. The radial arms of the support 45 are riveted to a flange 47 that extends inwardly from the bottom of the skirt 42 of the shroud 40. The shroud 40 extends upwardly from beneath the level of the floor 21 to a level above the openings in the spouts 20. As shown in FIG. 4, the inner bottom of the shroud 40 has downwardly sloping surfaces so that coins that are accidentally deposited inside the shroud 40 will exit through its open bottom and not become lodged between the shroud and the floor 24.

The shroud 40 can be rotated about the shaft 12 from a position in which the opening 43 is fully hidden by the stationary enclosure 25 to a position in which the opening 43 is away from the stationary enclosure 25 to provide access to the spouts 20 and bags which may be carried thereby.

A latch plate 50 is slidably mounted beneath the top portion 30 of the bracket 29. The latch plate 50 includes a pair of spaced ears 51 which can be moved into and out of engagement with the corners 52 of the opening 43 of the shroud 40. The latch plate 50 has a laterally extending handle 53 which extends through a slot 54 in one side of the stationary enclosure 25. A key lock 55 is mounted in the side of the stationary enclosure 25 adjacent to the slot 54. The key lock 55 includes a lever 56 that is adapted to be moved into and out of engagement with an arm 57 that extends downwardly depends from the latch plate 50. When the lock 55 is locked, the lever 56 is in a vertical position and the latch plate 50 is locked in a position in which the ears 51 engage the corners 52 of the opening 43 in the shroud 40. When the lock 55 is opened, the lever 56 will be moved to a horizontal position (see FIG. 4). The latch plate 50 can then be manually moved by grasping the handle 53 to a withdrawn position in which the ears 51 are out of engagement with the shroud. In that withdrawn position, the shroud can be rotated and the security compartment can be opened. The arm 57 terminates in a horizontal projection 58 which prevents the lever 56 of the key from engaging the wrong side of the arm 57.

The enclosure 25 and shroud 40 may be molded or formed from a plastic resin material, such as a high-density polyethylene. Preferably, the enclosure 25 and shroud 40 are formed by rotational molding. Such material has inherent sound deadening properties. The shroud support 45 may be molded from a plastic resin material, as well.

While the security compartment is shown with a coin sorter having spouts that mount coin bags, the compartment can be used to secure a variety of coin containers such as drawers and can be used with a variety of coin handling equipment which deposit coins into containers that must be secured.

We claim:

1. A security compartment for a coin handling apparatus having a plurality of coin containers arrayed in a circle around a centerline, said compartment comprising:

a stationary enclosure connected to the coin handling apparatus on one side of the circle; and a shroud mounted for rotation about the centerline and having an opening that may be hidden by the enclosure or exposed to provide access to the coin containers when the shroud is rotated.

2. A security compartment in accordance with claim 1 wherein the centerline is defined by a shaft that supports the coin handling apparatus, and the shroud is rotatably mounted on the shaft.

3. A security compartment in accordance with claim 1 together with a locking mechanism mounted on the enclosure and engageable with the shroud when the opening is hidden by the enclosure to prevent rotation of the shroud.

4. A security compartment for a coin handling apparatus having a plurality of coin containers arrayed along a portion of the perimeter of a circle, comprising:

a stationary enclosure connected to the coin handling apparatus and enclosing the portion of the perimeter that is not occupied by coin containers; and a shroud mounted for rotation about an axis substantially at the center of the circle and having an opening that may be hidden by the enclosure or exposed to provide access to the coin containers when the shroud is rotated.

5. A security compartment in accordance with claim 4 wherein the center of the circle is occupied by a shaft that supports the coin handling apparatus, and the shroud is rotatably mounted on the shaft.

6. A security compartment in accordance with claim 4 together with an actuable locking mechanism that engages the shroud when the opening is hidden by the enclosure to prevent rotation of the shroud.

7. A security compartment in accordance with claim 6 wherein the lock mechanism includes a manually movable latch engageable with the shroud, and a lock having a lever that engages the latch to prevent movement when the lock is locked.

8. A security compartment for a coin sorter having a plurality of coin spouts arrayed along a major portion of the perimeter of a circle, the sorter being supported on a stand having an upright shaft at the center of the circle and a circular floor spaced below the spouts, the compartment comprising:

a stationary enclosure connected to the stand and sorter and enclosing the portion of the circle that is not occupied by the spouts; and a shroud rotatably mounted on the shaft and having an opening that is sized to be hidden by the enclosure or to provide access to coin containers connected to the spouts when the shroud is rotated.

9. A security compartment in accordance with claim 8 in which the shroud is supported on the shaft beneath the floor, and the shroud extends from above the level of the spouts to beneath the floor.

10. A security compartment in accordance with claim 9 wherein the opening extends from above the level of the spouts.

11. A security compartment in accordance with claim 8 together with an actuable locking mechanism mounted on the enclosure and engageable with the shroud when the opening is hidden by the enclosure to prevent rotation of the shroud.

12. A security compartment in accordance with claim 11 wherein the lock mechanism includes a manually movable latch engageable with the shroud, and a lock having a lever that engages the latch to prevent movement when the lock is locked.

13. A security compartment in accordance with claim 12 wherein the latch is movable into and out of engagement with the sides of the opening.

14. A security compartment in accordance with claim 12 wherein the latch includes a handle that extends outwardly of the enclosure.

15. A security compartment for a coin sorter having a plurality of coin containers adjacent the front of the sorter, the sorter being supported on a stand, the compartment comprising:

a stationary enclosure connected to the stand and the sorter at the rear of the sorter; and a shroud for the containers having an opening that is sized to be hidden by the enclosure, the shroud being mounted on the stand for movement between a position in which the opening is within the enclosure and positions in which the opening is free of the enclosure and provides access to the coin containers.

* * * * *